US006190739B1

(12) United States Patent
Höffer et al.

(10) Patent No.: US 6,190,739 B1
(45) Date of Patent: Feb. 20, 2001

(54) LACQUERING APPARATUS AND METHOD

(75) Inventors: Michael Höffer, Wuppertal; Reiner Kasulke, Solingen, both of (DE)

(73) Assignee: Herberts GmbH, Wuppertal (DE)

( * ) Notice: Under 35 U.S.C. 154(b), the term of this patent shall be extended for 0 days.

(21) Appl. No.: 09/242,175

(22) PCT Filed: Aug. 7, 1997

(86) PCT No.: PCT/EP97/04299

§ 371 Date: Apr. 15, 1999

§ 102(e) Date: Apr. 15, 1999

(87) PCT Pub. No.: WO98/06503

PCT Pub. Date: Feb. 19, 1998

(30) Foreign Application Priority Data

| | | |
|---|---|---|
| Aug. 10, 1996 | (DE) | 196 32 325 |
| Aug. 10, 1996 | (DE) | 196 32 326 |
| Feb. 8, 1997 | (DE) | 197 04 829 |

(51) Int. Cl.[7] ..... B05D 1/02; B05D 1/28; B05B 13/02; B05B 12/14

(52) U.S. Cl. ..... 427/424; 118/305; 118/314; 118/315; 239/112; 239/113; 239/116; 222/148; 222/56; 222/81; 222/145.2

(58) Field of Search ..... 427/424; 118/305, 118/314, 315; 239/113, 112, 116; 222/148, 56, 81, 145.2

(56) References Cited

U.S. PATENT DOCUMENTS

| | | | | |
|---|---|---|---|---|
| 4,231,492 | * | 11/1980 | Rios | 222/1 |
| 4,728,034 | | 3/1988 | Matsumura et al. . | |
| 4,785,760 | | 11/1988 | Tholome . | |
| 4,792,092 | | 12/1988 | Elberson et al. . | |
| 4,905,871 | * | 3/1990 | Dutertre | 222/83 |
| 5,389,149 | * | 2/1995 | Carey et al. | 118/302 |
| 5,503,302 | * | 4/1996 | DeJonge | 222/82 |

(List continued on next page.)

FOREIGN PATENT DOCUMENTS

| | | |
|---|---|---|
| 28 19 302 | 11/1979 | (DE) . |
| 40 13 941 A1 | 10/1991 | (DE) . |
| 792 695 A2 | 9/1997 | (EP) . |
| WO9734707 | 9/1997 | (WO) . |
| 97/40946 | 11/1997 | (WO) . |

OTHER PUBLICATIONS

Patent Abstracts of Japan, vol. 015, No. 048 (C–0802), Feb. 5, 1991 & JP 02 280866 A (Nissan Motor Co Ltd), Nov. 16, 1990.

Patent Abstracts of Japan, vol. 095, No. 011, Dec. 26, 1995 & JP 07 227556 A (Mesatsuku:KK), Aug. 29, 1995.

Patent Abstracts of Japan, vol. 009, No. 271 (C–311), Oct. 29, 1985 & JP 60 122073 A (Tokico KK), Jun. 29, 1985.

Patent Abstracts of Japan, vol. 012, No. 450 (C–547), Nov. 25, 1988 & JP 63 175663 A (Nissan Motor Co Ltd), Jul. 20, 1988.

*Primary Examiner*—Shrive Beck
*Assistant Examiner*—Jennifer Kolb
(74) *Attorney, Agent, or Firm*—Pillsbury Madison & Sutro LLP

(57) ABSTRACT

A lacquering line and a method of lacquering industrially manufactured products in standard and/or special colours, having one or more guide devices (1) for the industrially manufactured products, having one or more lacquering cabins and having spraying elements (2) disposed along the guide devices (1) inside the lacquering cabins, wherein at least one lacquering cabin comprises one or more lacquering units, having one or more exchangeable small containers **(6, 6*a*), in which the lacquer quantity required for lacquering a predetermined number of individual products is packed ready to apply, as well as having a rinsing device (9), wherein the small containers (6, 6*a*) and the rinsing device (9) are connectable in each case by a lacquer conveying device (7) and one or more stub lines (8) directly or via a colour changer (11)** to the spraying elements.

21 Claims, 6 Drawing Sheets

U.S. PATENT DOCUMENTS 5,658,383 * 8/1997 Cutshall ..... 118/64
5,855,298 * 1/1999 Teetsel, III et al. ..... 222/81
5,882,735 * 3/1999 Takeuchi ..... 427/430.2
5,897,026 * 4/1999 Vester et al. ..... 222/5
6,037,010 * 3/2000 Kahmann et al. ..... 427/421

* cited by examiner

LACQUERING APPARATUS AND METHOD

FIELD OF THE INVENTION

The invention relates to a lacquering apparatus or lacquering line as well as to a lacquering method, which may be effected with said apparatus, for in particular products manufactured on an industrial scale or parts thereof, such as, for example, motor vehicle bodies or parts thereof.

In the following, the invention is described using the example of the lacquering of motor vehicle bodies although it is naturally also applicable to the lacquering of industrial products such as refrigerators and other appliances.

BACKGROUND OF THE INVENTION

Series lacquering of automobiles occurs in fully automated automobile lacquering lines, with application of the colour-determining lacquer layer (as a final outer lacquer layer or as a base lacquer layer of a two-coat lacquering comprising a base lacquer layer and an outer transparent lacquer layer) being effected in a limited number of standard colours, e.g. between 5 and 15, with frequent colour changing. The colour changing arises as a result of the production schedule and generally does not occur after the lacquering of just one body, the bodies instead usually being combined into groups of identical colour. The standard colours are lacquers, which are processed in bulk and are therefore in practice fed in each case from a lacquer storage container having a filling volume of e.g. 200 to 1500 litres through a separate ring line connected thereto to the lacquer spraying elements. Automatic colour changing merely involves a switchover by a colour changer from one ring line to another ring line containing lacquer of another standard colour and the lacquer spraying elements are automatically rinsed between the end of application of the one standard colour and the start of application of the next standard colour. In the case of supply by means of ring line systems, it is customary for the lacquers in the ring lines and storage containers to be circulated in order to ensure a uniform colouring and avoid separation of the lacquer. In said case, the lacquer in the agitating and pumping mechanisms is subject to increased shear, which may lead to a loading of the lacquer. For such an eventuality, it is usually necessary to take suitable counter-measures, e.g. the addition of additives or a particular choice of binding agents.

At the special request of customers, automobile manufacturers also lacquer individual vehicles or a low number of vehicles in special non-standard colours. The number of special colours far exceeds the number of standard colours and the special colours are processed only in small quantities compared to the standard colours. The special colours may be recurring colours but are predominantly one-off colours. Since the individual lacquering of motor vehicle bodies requires only around 4 to 10 litres of the colour-determining lacquer, it is therefore uneconomic and labour-intensive to use the same lacquering procedure for special colours as for standard colours. The use, for special lacquering, of the storage containers and ring lines customary for standard lacquering would entail a considerable surplus of lacquer, which would ultimately have to be thrown away. Furthermore, the rinsing of storage container and ring line would lead to additional expenditure of effort, additional use of solvent and additional disposal problems.

In practice, therefore, motor vehicle bodies which are to be lacquered in special colours are transferred out of the normal lacquering line for series lacquering and moved to a separate lacquering cabin or lacquering line. As a rule, bodies which have been precoated, e.g. provided with a layer of primer and filler, are transferred out of the lacquering line and lacquered e.g. with the base lacquer in a special colour. Then a transparent lacquer may be applied likewise in a separate manner or the body, having been lacquered in the special colour in a separate device, is then transferred back into the lacquering line, where it is provided with the outer transparent lacquer layer and conveyed to the further conventional lacquering and stoving devices. This requires additional technical appliances outside of the conventional lacquering line as well as elaborate operations for transferring the body to be separately lacquered out of and back into the conventional lacquering line.

In "Journal für Oberflächentechnik" JOT, 9, 1996, page 28, Grau describes how it may be possible in future to dispense with the conventional lacquer supply using lacquering robots. The central feature of the new system is a magazine having a flexible number of exchangeable containers. Integrated into the magazine are devices for filling and rinsing an exchangeable container. The system automatically distinguishes between the colours of a high or low consumption probability, i.e. it distinguishes between standard and special colours. At the point of use, refilling of the colour containers of the high consumption probability is effected, while the colour containers of a low consumption probability first have to be rinsed. Depending on requirements, filling may be effected via a ring line or manually. Reference is made to the extreme suitability of the system for applying special colours on account of the possible savings on lacquer material compared with the conventional procedure of the filling of ring lines. The procedure described here however also inevitably involves handling of the lacquers by the operator, e.g. liquid lacquer has to be handled particularly during filling and emptying operations at the exchangeable containers. Furthermore, it is necessary to rinse at least the exchangeable containers for special colours. All of this constitutes not only an undesirable expenditure of effort for the operator but also entails risks of contamination, particularly in connection with rinsing and cleaning operations at the exchangeable containers. The operator is namely compelled to guarantee an adequate cleanness of the containers prior to refilling.

From DE 28 19 302 B2 a lacquering line is known, having a guide device for vehicle bodies and having spray elements, which are disposed along the guide device inside a spraying cabin and are connected by feed lines via one or more ring lines to one or more lacquer storage containers. Also described is a cleaning process for contaminated lines and spraying elements. One or more units for the individual lacquering of bodies or body parts are integrated into the apparatus. The controllable lacquer pressure regulators perform the function of colour changers connected to the spray elements.

From JP-2-280866 A in: Patent Abstracts of Japan, C-802, Vol. 15, No. 48 of 05.02.1991, a plurality of small paint containers combined into a unit are known, which are connectable by a colour changer to a spraying element.

From DE 40 13 941 A1 a small container of a vehicle body lacquering installation is known, the total filling volume of which is sufficient for lacquering one body or one part thereof.

SUMMARY OF THE INVENTION

The object of the invention is to provide an apparatus and a method, which may be effected with said apparatus, for lacquering, in particular for the individual lacquering or the series lacquering of products manufactured industrially in high numbers, e.g. preferably for the series lacquering of motor vehicles or parts thereof with lacquers. In so doing, products are to be capable of manufacture in different colours, in accordance with a colour range.

Examples are the lacquering of base layers and outer layers in standard and/or special colours. An efficient design of the apparatus as well as an efficient process control are to be made possible. Filling and emptying operations involving liquid lacquer, as well as rinsing and cleaning steps within the apparatus are to be extensively avoided.

It has been shown that said object may be achieved by the apparatus forming the subject-matter of the invention in the form of a lacquering line for lacquering industrially manufactured products in standard and/or special colours, having one or more guide devices for the industrially manufactured products, having one or more lacquering cabins and having spraying elements disposed along the guide devices inside the lacquering cabins, which is characterized in that at least one lacquering cabin comprises one or more lacquering units, having one or more exchangeable small containers, in which the lacquer quantity required for lacquering a predetermined number of individual products is packed ready for application, as well as having a rinsing device, wherein the small containers and the rinsing device are connectable in each case by a lacquer conveying device and one or more stub lines directly or via a colour changer to the spraying elements.

The invention also relates to the lacquering method which may be effected with the apparatus.

The apparatus according to the invention is suitable for a method of lacquering industrially manufactured products in standard and/or special colours using the apparatus. The apparatus as well as the method are suitable for parallel operation of a lacquering line for the series lacquering of motor vehicle bodies in standard colours and special colours. The lacquers in a standard and/or special colour, which are packed ready for application in a predetermined quantity required for lacquering, are fed from small containers located in the vicinity of the spraying elements. This may occur, for example, in a conventional lacquering line for motor vehicle bodies and a transfer of bodies to be lacquered in a special colour out of the conventional lacquering line may be avoided. Furthermore, there is in particular no need for lacquer storage containers and ring lines connected thereto to be filled with lacquers for special colours and subjected, after the individual lacquering, to elaborate emptying and rinsing operations with the associated material losses.

The spraying elements as such are not subject to any restrictions, it being possible to use conventional spraying elements for the application of liquid coating agents. Examples are manually operated or automatically controlled spraying elements, e.g. spray guns, high-speed rotary bells, lacquering robots and automatic lacquering machines. The spraying elements may be operated pneumatically or without air assistance, optionally with electrostatic assistance.

Nor is the nature of the industrially manufactured products to be lacquered subject to any fundamental restriction, the industrially manufactured products preferably being motor vehicle bodies or parts thereof. The term "products" used here means industrially manufactured products, preferably motor vehicle bodies and parts thereof. Thus, the invention, in terms of the lacquering of industrially manufactured products, preferably relates to a lacquering line for the series lacquering of motor vehicle bodies in standard and/or special colours as well as to a method of lacquering within the lacquering line. In said case, the lacquers in a standard and/or special colour are, within the lacquering line which comprises one or more lacquering cabins for applying the lacquers in a standard and/or special colour, packed ready for application in a predetermined quantity required for lacquering and fed from small containers located in the vicinity of the spraying elements.

The lacquering units used according to the invention and comprising small containers may be provided in separate lacquering cabins integrated into the lacquering line. They may however alternatively be integrated into conventional lacquering cabins provided with one or more ring lines.

Thus, the invention according to a first embodiment relates to a lacquering line for lacquering industrially manufactured products in standard and/or special colours, having one or more guide devices for the industrially manufactured products, having one or more lacquering cabins and having spray elements disposed along the guide devices inside the lacquering cabins, wherein at least one lacquering cabin A comprises one or more lacquering units having one or more exchangeable small containers, in which the lacquer quantity required for lacquering a predetermined number of individual products is packed ready for application, as well as a rinsing device, and wherein the small container or containers and the rinsing device are connectable in each case by a lacquer conveying device and one or more stub lines directly or via a colour changer to the spraying elements, and optionally for the lacquering in standard colours is equipped with one or more further lacquering cabins B comprising spraying elements, which are disposed along the guide devices inside said lacquering cabins and are connected by feed lines via one or more ring lines to one or more lacquer storage containers and a rinsing device.

In the first embodiment of the invention, a distinction has to be made between lacquering cabins of type A, referred to as lacquering cabins or spraying cabins A, and lacquering abins of type B, referred to as lacquering cabins or spraying cabins B. In the case of the spraying elements isposed inside the lacquering cabins A, the lacquer supply is effected exclusively via a small container system, i.e. a lacquering cabin A is a lacquering cabin, inside which spraying elements are disposed, wherein the lacquering cabin comprises one or more lacquering units, wherein one unit comprises one or more exchangeable small containers, in which the lacquer quantity required for lacquering a predetermined number of individual products is packed ready for application, as well as a rinsing device, and wherein the small container or containers and the rinsing device are connectable in each case by a lacquer conveying device and one or more stub lines directly or via a colour changer to the spraying elements. In the case of the spraying elements disposed inside the lacquering cabins B, on the other hand, the lacquer supply is effected exclusively via a ring line system, i.e. a lacquering cabin B is a lacquering cabin, which is supplied with lacquer in a conventional manner and inside which are disposed spraying elements, which are connected by feed lines via one or more ring lines to one or more lacquer storage containers and a rinsing device.

For example, the lacquering line within the first embodiment of the invention comprises a plurality of lacquering cabins for the application of lacquers in a standard and/or special colour, e.g. two lacquering cabins, wherein in the respective lacquering cabins different colours from the colour range are applied. Thus, for example, in the one lacquering cabin the standard colours may be applied and in the further lacquering cabin(s) the special colours may be applied. In said case, the lacquer supply in standard colours may be effected in the usual manner, i.e. using the known, initially mentioned lacquer storage containers and ring lines, i.e. in lacquering cabins B. The lacquer supply in standard colours is however preferentially effected using the small container system, i.e. in lacquering cabins A. The lacquer supply in special colours, on the other hand, is effected exclusively using the small container system, i.e. in lacquering cabins A. In said case, the products to be lacquered in special colours are fed to the lacquering cabin A used for applying the special colours. For example, products which have been precoated, e.g. provided with a layer of primer and filler, are lacquered with base lacquers of a special colour. Then a transparent lacquer may be applied or the products lacquered in special colours are re-inserted between products lacquered in standard colours and then provided with the outer transparent lacquer layer and fed to the further customary lacquering and stoving devices. By virtue of the invention, there is no need for lacquer storage containers and ring lines connected thereto to be filled with lacquers for special colours and subjected, after lacquering, to elaborate emptying and cleaning operations with the associated material losses. In the preferred case of the supply of lacquers in standard colours being effected likewise using the small container system, the same advantages arise as for the special colours.

Thus, the first embodiment of the invention relates to a lacquering line for the series lacquering of industrially manufactured products, having one or more guide devices for the products and having spraying elements disposed along the guide devices inside two or more spraying cabins, wherein the spraying elements in the spraying cabin or cabins B, e.g. the spraying cabins operated with standard colours, may be connected by one or more ring lines to one or more lacquer storage containers and a rinsing device. In the case of said lacquering line, in the further spraying cabin or cabins A, e.g. the spraying cabin(s) operated with special colours, the lacquer supply to the spray elements operated therein is not effected from lacquer storage containers via ring lines. Preferably, the lacquer supply in none of the spraying cabins is effected from lacquer storage containers via ring lines, rather all of the spraying cabins are spraying cabins A, which comprise one or more units for lacquering products, wherein the respective unit comprises one or more exchangeable small containers, the total filling volume of which corresponds to the lacquer quantity required for lacquering a predetermined number of individual products, as well as a rinsing device, wherein the small containers and the rinsing device are connectable in each case by a lacquer conveying device and one or more stub lines directly or via a colour changer to the spraying elements.

In a preferred manner, the lacquering line within the first embodiment of the invention comprises only one lacquering cabin A, in which standard and/or special colours are applied. The supply of lacquer in standard and/or special colours is in said case effected exclusively using the small container system. Operations for the inward and outward transfer of products to be lacquered may be avoided. Also eliminated are the customary ring line systems and the drawbacks associated therewith.

A preferred subject-matter of the invention is therefore formed by a lacquering line for the series lacquering of industrially manufactured products, having a guide device for the products and having spraying elements disposed along the guide device inside only one spraying cabin A, wherein the spraying elements are connected to one or more units for lacquering the products, wherein the respective unit comprises one or more exchangeable small containers, the total filling volume of which corresponds to the lacquer quantity required for lacquering a predetermined number of individual products, as well as a rinsing device, wherein the small containers and the rinsing device are connectable in each case by a lacquer conveying device and one or more stub lines directly or via a colour changer to the spraying elements.

In a second embodiment, the invention relates to a lacquering line for lacquering industrially manufactured products in standard colours and special colours, having a guide device for the industrially manufactured products and having spraying elements, which are disposed along the guide device inside one or more spraying cabins C and are connected by feed lines via one or more ring lines to one or more lacquer storage containers and a rinsing device, wherein the lacquering line has integrated therein one or more units for the individual lacquering of products, wherein one unit comprises one or more exchangeable small containers, the total filling volume of which corresponds to the lacquer quantity required for lacquering a predetermined number of individual products, as well as an additional rinsing device, wherein the small containers and the additional rinsing device are connectable in each case by a lacquer conveying device and one or more stub lines directly or via a colour changer to the spraying elements. In the case of the spraying elements disposed inside the lacquering cabin or cabins C, the supply of lacquer in the special colours is effected via a small container system as described above for the lacquering cabins of type A, while the supply of lacquer in the standard colours is effected via a ring line system as described above for the lacquering cabins of type B.

In said second embodiment of the apparatus according to the invention, the same spraying elements may be used both for lacquering in standard colours and for lacquering in special colours. The spraying elements are generally located close to one another. They are disposed along the guide device for the products which are to be lacquered, e.g. vehicle bodies, i.e. laterally of, as well as above, the guide device and optionally also under the guide device.

It is advantageous and preferred when the small container system is installed in the vicinity of the spraying elements, i.e. the spraying elements, which are supplied with lacquer using the small container system, are preferentially connectable by short feed lines, i.e. along the shortest possible route, e.g. by short pipes or tubes to the small container system.

In the second embodiment of the invention, for example, each spraying element disposed inside spraying cabins C is connected by the conventional feed lines and ring lines to the lacquer storage containers for standard colours. In addition, the spraying elements are connectable by short feed lines, i.e. along the shortest possible route, e.g. by short pipes or tubes to the small container system for the special lacquering processes. The feed lines to the ring line and/or the short feed lines are provided with valves, which in each case enable the required supply of standard colour or special colour. The valves of the feed line of a ring line and of the short feed lines may be automatically coupled.

In the case of the apparatus according to the invention, each spraying element may be connected by a separate feed line to the lacquer supply unit for the lacquer in a standard and/or special colour. Preferably, however, the feed lines of a plurality of spraying elements or of all spraying elements, especially when the latter are located close to one another, are combined into a single feed line and connected to the respective small container. For example, the spraying elements disposed at one side as well as the spraying elements disposed above the guide device may in each case be combined and connected by a single feed line to the small container.

The spraying elements may also be connected by so-called colour changers to the feed lines for the standard and/or special colours. Such colour changers automatically disconnect the one feed line at the end of application of the corresponding colour, in-roduce rinsing liquid into the system and then connect the new feed line for the next colour. In the second embodiment of the invention, for example, the spraying elements may be connected by the colour changers to the feed lines for the standard colours and to the short feed lines for the special colours. The colour changers automatically disconnect the conventional ring line systems at the end of one standard colour, introduce rinsing liquid into the system and then connect the new ring line for a further standard colour. The short feed lines used in accordance with the invention may also be integrated into said colour changing system so that a switchover of the generally automatically operating colour changers from standard colours to special colours and vice versa is made possible.

The lacquer supply system comprising the small containers, the rinsing device and the lacquer conveying device, as well as optionally apparatuses for connecting the lacquer conveying device to the small containers and optionally automatic apparatuses for supplying and removing the small containers, is preferably situated in the immediate vicinity of an optionally provided colour changer. It is thereby ensured that there are only short distances and hence only short clearance volumes between small containers, colour changer and connecting lines to the spraying elements. This leads to a low consumption of unused lacquer as well as to low quantities of the rinsing liquid required for cleaning the lacquer conveying device, the stub lines and the spraying elements.

The lacquer supply device based on the small containers may, where necessary, also be disposed inside the lacquering cabins A and/or C, in which the spraying elements are situated. This is possible particularly because the small containers, as described above, are tightly sealed. Contamination of the contents, e.g. by spray mist, may thereby be avoided. It is also advantageous to screen off the lacquer supply unit based on the small containers from contamination, especially by spray mist.

The lacquer supply unit for supplying the standard and/or special lacquers comprises one or more exchangeable small containers. The dimensions of the small containers may be adapted to requirements. Their size may, for example, be such that one or more containers are usable for lacquering one body unit. It is however also possible to design the small containers in such a way that a plurality of vehicle bodies or parts thereof may be lacquered from a single small container. Generally, the filling volume of the small containers is preferably in the order of magnitude of 0.5 to 10 litres. The basic assumption is that the lacquering of one vehicle body generally requires a lacquer quantity in the order of magnitude of 4 to 10 litres.

Tightly sealed small containers may be used so that contamination and fouling of the lacquer contents from the environment are avoided. It is advantageous when the small containers have metal or plastic surfaces as the latter may be cleaned at any time.

Conventional removal devices may be used to convey the lacquer out of the small containers. According to a preferred embodiment, a rising pipe may be introduced into the small containers. In addition, the lacquer conveying device is equipped, for example, with a pumping system or a device for applying a pressure medium such as, for example, compressed air or an inert gas. According to a further preferred embodiment, the lacquer conveying device is designed in such a way that it may likewise be introduced into the rinsing device, in which a rinsing solution is situated. By means of the pumping or pressure medium the rinsing solution may, e.g. with an alternating air/rinsing agent flow, then be conveyed through the conveying device, the feed lines and the optionally provided colour changer to the spraying elements.

In a preferred manner, the lacquer conveying device may be connected in a sealing manner to the small container. For example, the lacquer conveying device may take the form of a bell, which may be placed in a sealing manner over the small container. In a preferred manner, the lacquer conveying device may be introduced in a sealing manner into the small container. In the case of said embodiments, it is possible to convey the lacquer by means of a pressure medium, such as compressed air, or by means of a pumping system to the spraying devices.

So that the lacquer conveying device in the form of a rising pipe used in the preferred embodiment described above may be introduced in a sealing manner into the small container, the latter may for example be provided with a pierceable self-sealing closure. It is then possible, for example, for the line for the pressure medium also to be inserted in a self-sealing manner into said closure. The line for the pressure medium may however alternatively be combined with the rising pipe, e.g. in the form of a double pipe. According to a further embodiment, rising pipe and pressure line may be integrated into a lid, which may be fitted tightly onto the small container.

The small containers may be made of various materials, for example plastic material or metal, e.g. sheet metal, aluminium, steel, and may optionally also be provided at the inside with a surface coating. Such a surface coating or the containers as such have to be inert to the lacquer contents. They may be handled like one-trip containers which are disposed of, when empty. In a preferred manner, they are refillable containers which, when empty, may be cleaned and refilled in situ by the user, e.g. the vehicle manufacturer. Cleaning and refilling of the small containers is however preferably effected at the premises of the lacquer manufacturer or lacquer supplier. In the case of refillable containers and/or the use of aqueous lacquers, e.g. water-based lacquers, the small containers are preferably made of special steel.

The closure of the small container may be formed, for example, from a pierceable foil. The pierceable foil may be made of a material which encloses the introduced conveying device in a self-sealing manner.

It is advantageous for the small containers to carry a feature identifying their contents, e.g. a bar code which may be automatically read prior to opening of the small container. In a preferred manner, the bar code may also be used moreover to supply application data pertaining to the lacquer of the colour in question, e.g. for control of the spraying elements.

The design of the small containers as such is not subject to any restriction. It may be geared to the nature of the specific lacquer supply unit. Small container and lacquer conveying device are combined, as explained above, into a sealing lacquer supply system which may be handled automatically as a closed system. The small containers are, for example, cartridges, tins, bottles or other containers which, for example, have a capacity of between 0.5 and 10 litres. The small containers may be in various shapes, e.g. they may be cylindrical, cuboidal or cube-shaped. At one end they have a closure, which may take the form of a lid or a foil (e.g. made of metal or plastic material). The closure may alternatively take the form of a preformed segment of the container surface, e.g. a punched window, or a preformed outlet spout.

The lacquer supply device preferably has an opening apparatus for the small containers. The small containers may therefore be connected for example at the lid described above, e.g. by a piercing, cutting, pressing-in, drilling-through, screw-on action, to the lacquer conveying device. In said case, the opening may be directed, for example, upwards; it may however alternatively be oriented in another direction, e.g. downwards.

The small container may also be of a compression-proof design, i.e. the lacquer may then be expressed from the small container by exerting excess pressure with a pressure medium, e.g. air or an inert gas such as nitrogen. If the small container is not sufficiently compression-proof, it is then advantageous for the small container to be previously introduced into a suitably shaped, larger, compression-proof outer container; this has the advantage that the outer container is also easy to seal with a preformed lid, into which the conveying device is or may be integrated. In said case, it is possible to subject either only the small container or the entire outer container to a corresponding pressure in order to convey the lacquer out of the small container. However, another possibility is, for example, to use a pumping or suction apparatus to convey the lacquer out of the small container. In said case, it is preferred when the shape of the small container is such as to produce a minimum clearance volume with regard to the connection to the lacquer conveying device. To said end, it is possible for e.g. the base or lid of the small container to have preferably an outwardly curved conical or round shape.

The lacquer supply unit comprising small containers, conveying device, rinsing device and feed lines is preferentially used to supply lacquers in a standard and/or special colour to the spraying elements disposed inside lacquering cabins A and/or to supply lacquers in a special colour to the spraying elements disposed inside lacquering cabins C of a lacquering line for the series lacquering of industrially manufactured products, e.g. a motor vehicle lacquering line for series lacquering. The lacquer supply unit may have an opening device for the small containers, which is used to enable the sealing connection of lacquer conveying device to small containers. It is advantageous to supplement the lacquer supply unit with a feed device for one or more small containers as well as a removal device for the emptied small containers. The feed device may be, for example, a transport belt or other conventional feed device; the same applies to the removal device. The lacquer supply unit then substantially comprises a device for feeding the small containers to an opening device for the small containers, and a lacquer conveying device which connects in a self-sealing manner to in each case one opened small container, a removal device for the empty small containers as well as an automatic rinsing apparatus for the parts of the lacquer supply unit which come in contact with lacquer, e.g. also for the opening device if it comes into contact with lacquer.

In a preferred manner, opening device and lacquer conveying device are combined with one another, e.g. in the form of a piercing apparatus. Such a piercing apparatus, wherein the lacquer conveying device is punched into the small container, is suitable when the closure lid or the closure foil of a small container is pierceable.

When the small containers are, for example, cartridges containing the lacquer, said cartridges are connected to a lacquer conveying device which is suitable for supplying the required quantity of lacquer to the spraying elements, e.g. through automatically controlled operation of the expressing apparatus of the cartridge, which has been opened, for example, by cutting or piercing.

In the conveying device for the small containers, the small containers may be secured, either directly or in a compression-proof outer container, by a holding apparatus. The holding apparatus may operate, for example, in a mechanical, pneumatic or magnetic manner. The lacquer conveying device may be inserted at the exposed side of the secured small container. In said case, it is possible to place a piercing, pressing or screw-type apparatus onto the small container. Said apparatus is to effect sealing. The seal may be made, for example, of an elastic material such as rubber, Teflon or Viton. At the same time, the conveying device is introduced into the small container and positioned so as to be situated close to, or at, the lowest point of the container. The lacquer may then be conveyed out of the small container, e.g. by applying pressure or by means of a suction pump. It is also possible for the lacquer conveying device to be of an adjustable design which allows it to be fitted in a sealing manner onto small containers of varying size. This promotes flexible use of the lacquer conveying device.

A device for rinsing the parts which come into contact with the lacquer is simultaneously integrated into the lacquer supply device. Said parts include the interior of the piercing apparatus, as well as the necessary pumps or pressure devices. By introducing a rinsing solution, the corresponding stub lines to the spraying elements and the spraying elements may also be cleaned. The same also applies to a colour changer optionally inserted between stub lines and spraying elements. The rinsing device may for example be so designed that the lacquer conveying device, after removal from the relevant small container, is introduced into a container holding rinsing solution. By said means, the outer parts of the lacquer conveying device (particularly a rising pipe) which come into contact with lacquer are cleaned and, as a result of a pumping operation or application of a pressure medium, the rinsing solution passes also into the interior of the lacquer conveying system and reaches the further elements connected thereto. Generally, the rinsing operation is effected with an alternating air/rinsing medium flow. The rinsing device is preferably so designed that lines are provided, which convey the rinsing liquid during the rinsing operation into a suitable collecting container. It is also possible to install additional cleaning devices which, after removal of the lacquer conveying device from the rinsing device, remove any lacquer contamination still adhering to the outside. The lacquer conveying device may then be fed to further small containers which, for example, contain lacquers in further colours.

A further subject-matter of the invention is a method of lacquering industrially manufactured products, preferably motor vehicle bodies or individual parts of motor vehicle bodies in standard and/or special colours in one of the lacquering lines for series lacquering which have been defined above as being in accordance with the invention. The small containers are connected by the described conveying device as well as the stub lines optionally via a colour changer directly to the relevant spraying elements, i.e. it is a closed system. After the required number of products have been lacquered, the relevant lacquer supply unit is disconnected and the conveying device with the stub lines is rinsed, rinsing being effected by the rinsing device of the lacquer supply unit. The disconnection may be effected by means of valves or by means of a colour changer. The spraying elements may also be cleaned by the rinsing device of the lacquer supply unit; cleaning of the spraying elements is however also possible by means of conventional rinsing devices of lacquering lines for series lacquering.

A further subject-matter of the invention is also a method of effecting special lacquering of individual motor vehicle bodies or individual parts of motor vehicle bodies within a conventional lacquering line for motor vehicle series lacquering. Said method is such that the individual bodies or parts to be lacquered are, without being transferred out of the conventional lacquering line, introduced by means of the conventional guide devices into a spraying cabin C having the spraying elements used for the series lacquering. The ring and feed lines required for the series lacquering are disconnected by means of valves or by means of an automatic colour changer and the spraying elements are cleaned by means of conventional rinsing devices. The lacquer supply unit for supplying small quantities of lacquer is then provided with the quantity of small containers required for the individual lacquering, which small containers contain the requisite lacquer in a special colour. The small containers are connected by the described conveying device as well as the stub lines optionally via a colour changer directly to the spraying elements. After the required number of bodies or body parts have been lacquered, the lacquer supply unit integrated into the lacquering line is disconnected and the conveying device with the stub lines is rinsed, rinsing being effected by the additional rinsing device of the lacquer supply unit. In said manner, a precisely measurable quantity of special lacquer for individual lacquering operations may be applied, with the result that an unnecessary consumption of lacquer as well as associated cleaning operations and environmental pollution may be avoided.

The invention makes it possible for lacquers in standard and/or special colours to be processed efficiently alongside one another in one lacquering line. The volume of lacquer waste arising from the application of special colours is markedly reduced compared to current practice.

The handling of liquid lacquer by the user in the form of filling and emptying operations as well as rinsing and cleaning operations is extensively or—in the case of exclusive lacquer supply via the small container system—totally avoided.

DETAILED DESCRIPTION OF THE PREFERRED EMBODIMENTS

Figure 1:
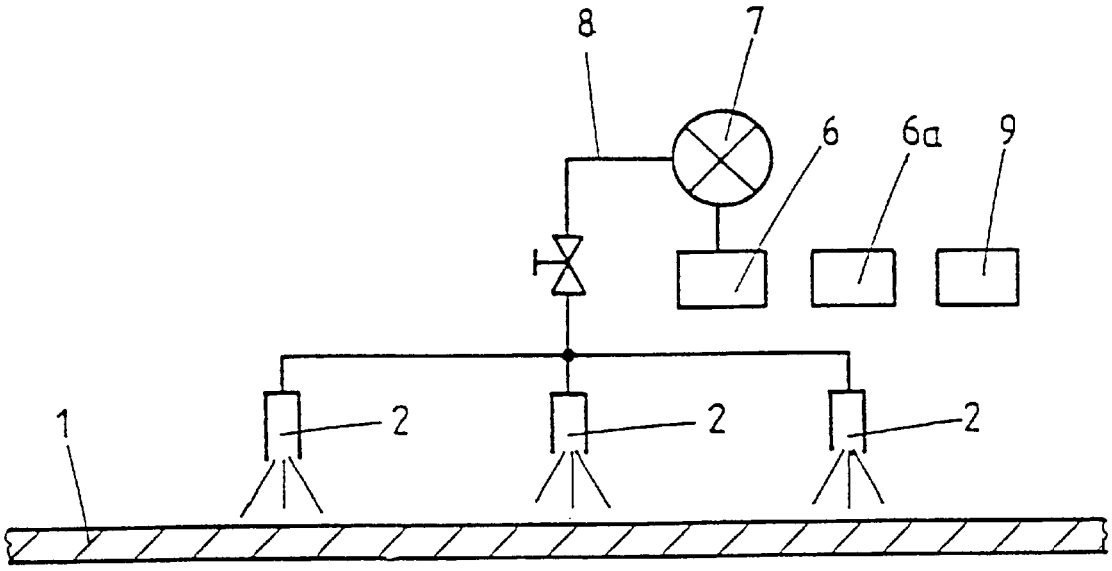
FIG. 1 shows, schematically, a lacquering line having a lacquering cabin of type A.

The accompanying FIG. 1 diagrammatically illustrates an example of a lacquering line having a lacquering cabin of type A. The products to be lacquered are conveyed on a conventional guide device (1) to the spraying elements (2). The latter are situated in a spraying cabin A (not shown) so that they are sealed off from the environment. The Figure shows a lacquer supply unit comprising one or more small containers (in the FIG. 2 small containers (6) and (6*a*) are shown), which are connectable by a conveying device (7) and stub line (8) as well as valves to the spraying elements (2). To guarantee the connectability, the conveying unit (7) for example may take the form of a rising pipe with a pumping or pressure medium system, the rising pipe being insertable into the small containers (6), (6*a*) or the rinsing device (9).

Figure 2:
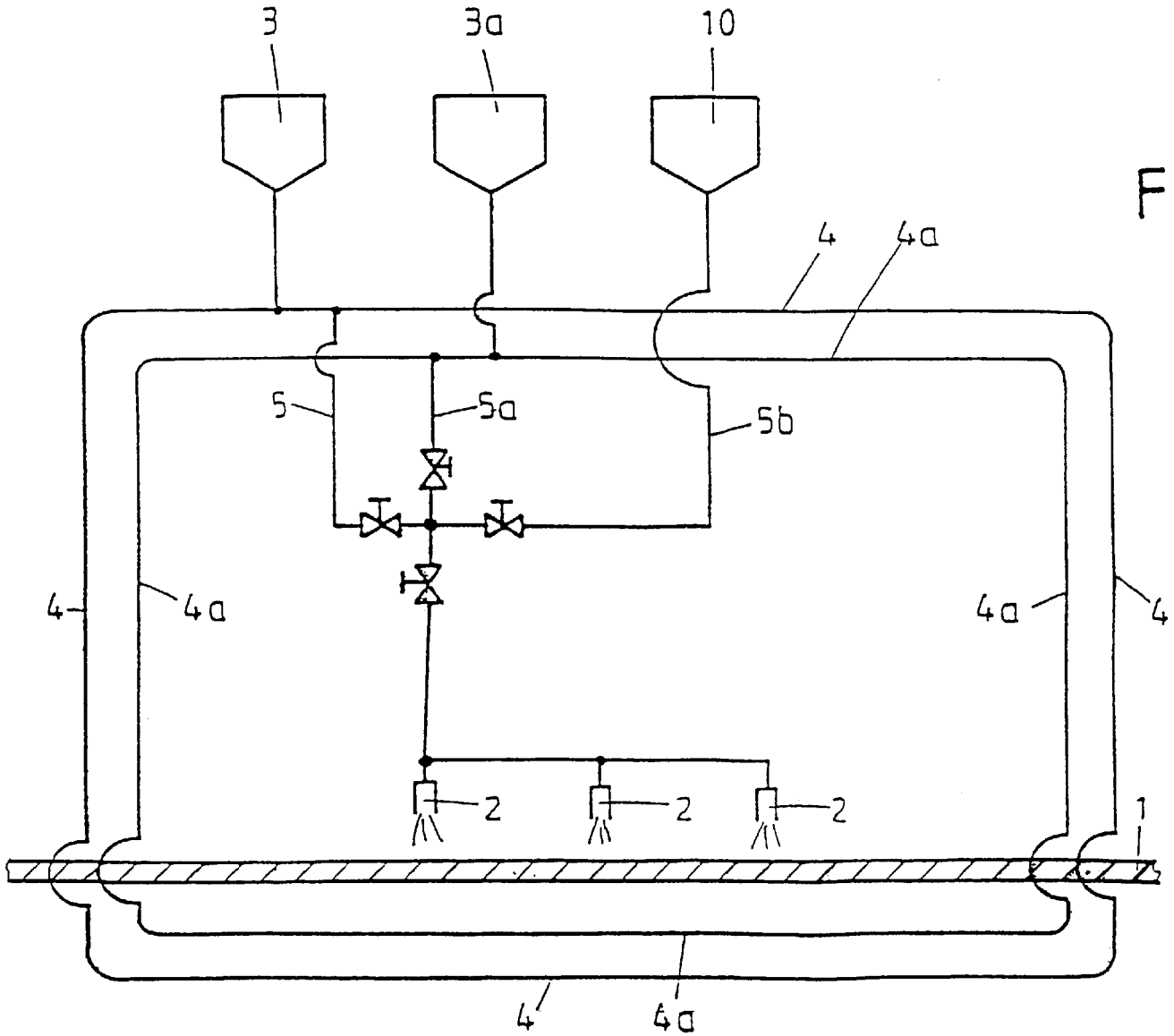
FIG. 2 shows, schematically, a lacquering line having a lacquering cabin of type B.

The accompanying FIG. 2 diagrammatically illustrates an example of a lacquering line having a lacquering cabin of type B. The products to be lacquered are conveyed on a conventional guide device (1) to the spraying elements (2). The latter are situated in a spraying cabin B (not shown) so that they are sealed off from the environment. The Figure shows two lacquer storage containers (3) and (3a) with the associated ring lines (4) and (4*a*), which contain standard lacquers used for series lacquering. Such an installation is naturally not limited to a specific number of such lacquer storage containers and ring lines. The number may be varied according to requirements. The standard lacquers run through feed lines (5) and (5*a*) via valve systems and conveying devices (not shown) to the spraying elements (2). A rinsing device (10), comprising a container for rinsing solution and a feed line (5*b*) to the spraying elements, is used to clean the line systems as well as the spraying elements prior to a colour change, e.g. a change from container (3) to container (3*a*).

Figure 2A:
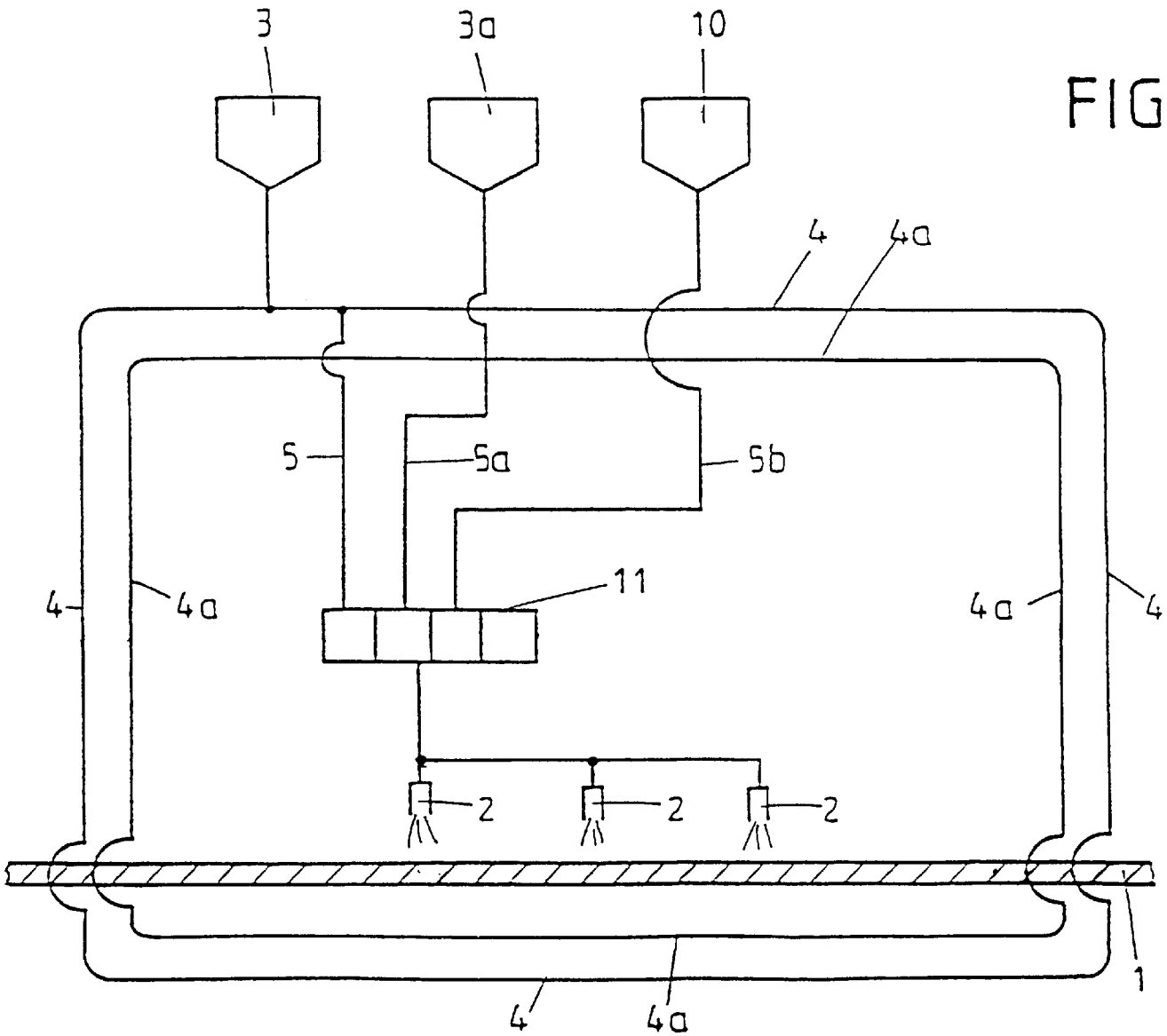
FIG. 2*a* shows, schematically, a system of FIG. 2 having a colour changer.

The accompanying FIG. 2*a* illustrates the same system as described in FIG. 2; the reference characters each have the same significance as in FIG. 1. Unlike FIG. 1, the embodiment of the invention illustrated in FIG. 2 comprises a colour changer (11). Such a colour changer automatically regulates the supply of lacquers from the individual lacquer storage containers (3) and (3*a*) and the rinsing device (10) to the spraying elements (2). One regulating unit is provided for each lacquer system. The same applies to the rinsing device (10).

Figure 2B:
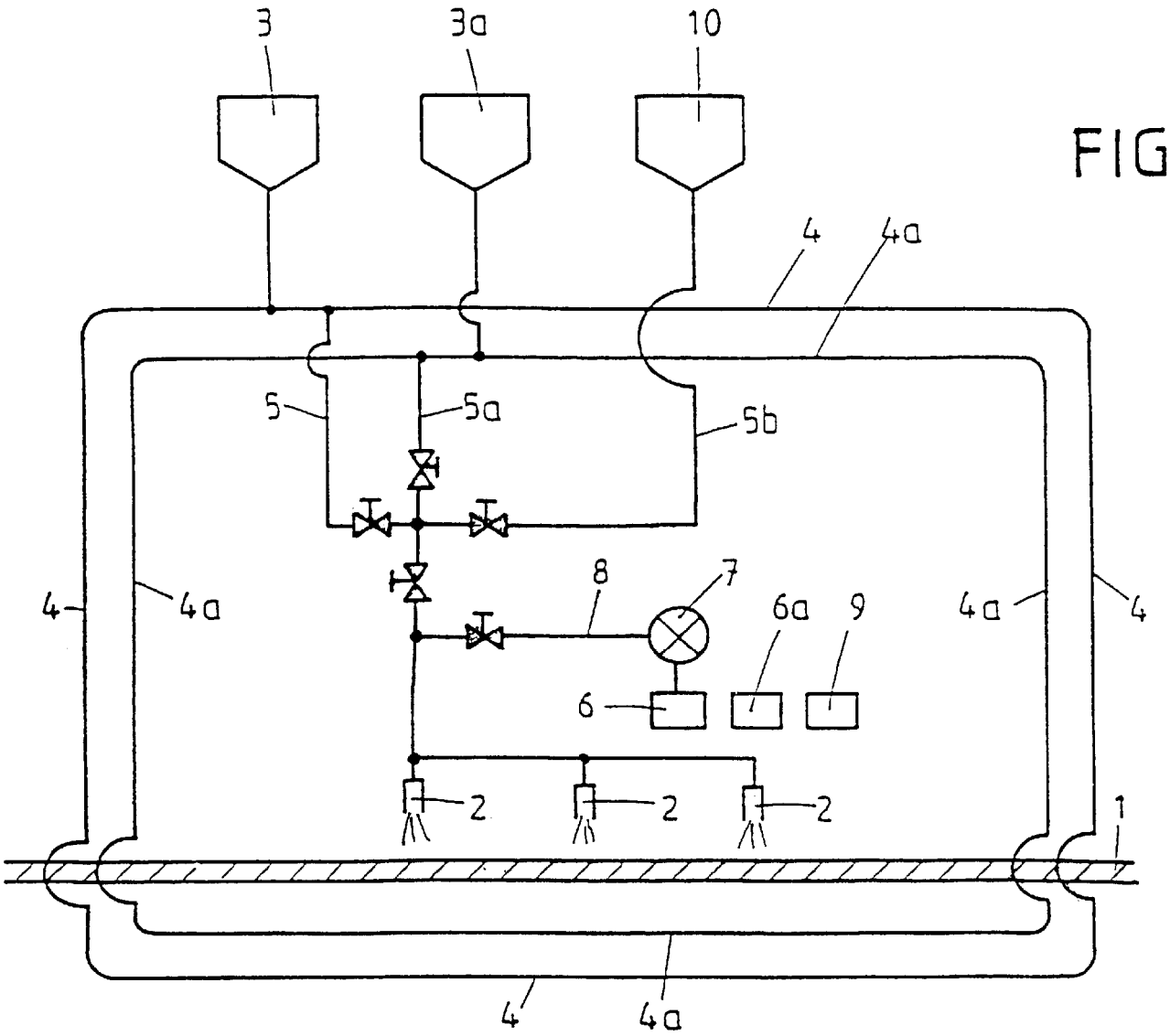
FIG. 2*b* shows, schematically, a lacquering line having a lacquering cabin of type C.

The accompanying FIG. 2*b* diagrammatically illustrates an example of a lacquering line according to the invention having a lacquering cabin of type C. The products to be lacquered are conveyed on a conventional guide device (1) to the spraying elements (2). The latter are situated in a spraying cabin C (not shown), so that they are sealed off from the environment. The Figure shows two lacquer storage containers (3) and (3*a*) with the associated ring lines (4) and (4*a*), which contain the standard lacquers used for series lacquering. Such an installation is naturally not limited to a specific number of such lacquer storage containers and ring lines. The number may be varied according to requirements. The standard lacquers run through feed lines (5) and (5*a*) via valve systems and conveying devices (not shown) to the spraying elements (2). A rinsing device (10), comprising a container for rinsing solution and a feed line (5*b*) to the spraying elements, is used to clean the line systems as well as the spraying elements prior to a colour change, e.g. a change from container (3) to container (3*a*). Integrated into the system is a lacquer supply unit, comprising one or more small containers (in the Figure two small containers (6) and (6*a*) are shown), which are connectable by a conveying device (7) and stub line (8) as well as valves to the spraying elements (2). To guarantee connectability, the conveying unit (7) for example may take the form of a rising pipe with a pumping or pressure medium system, the rising pipe being insertable into the small containers (6) (6*a*) or the rinsing device (9).

Figure 2C:
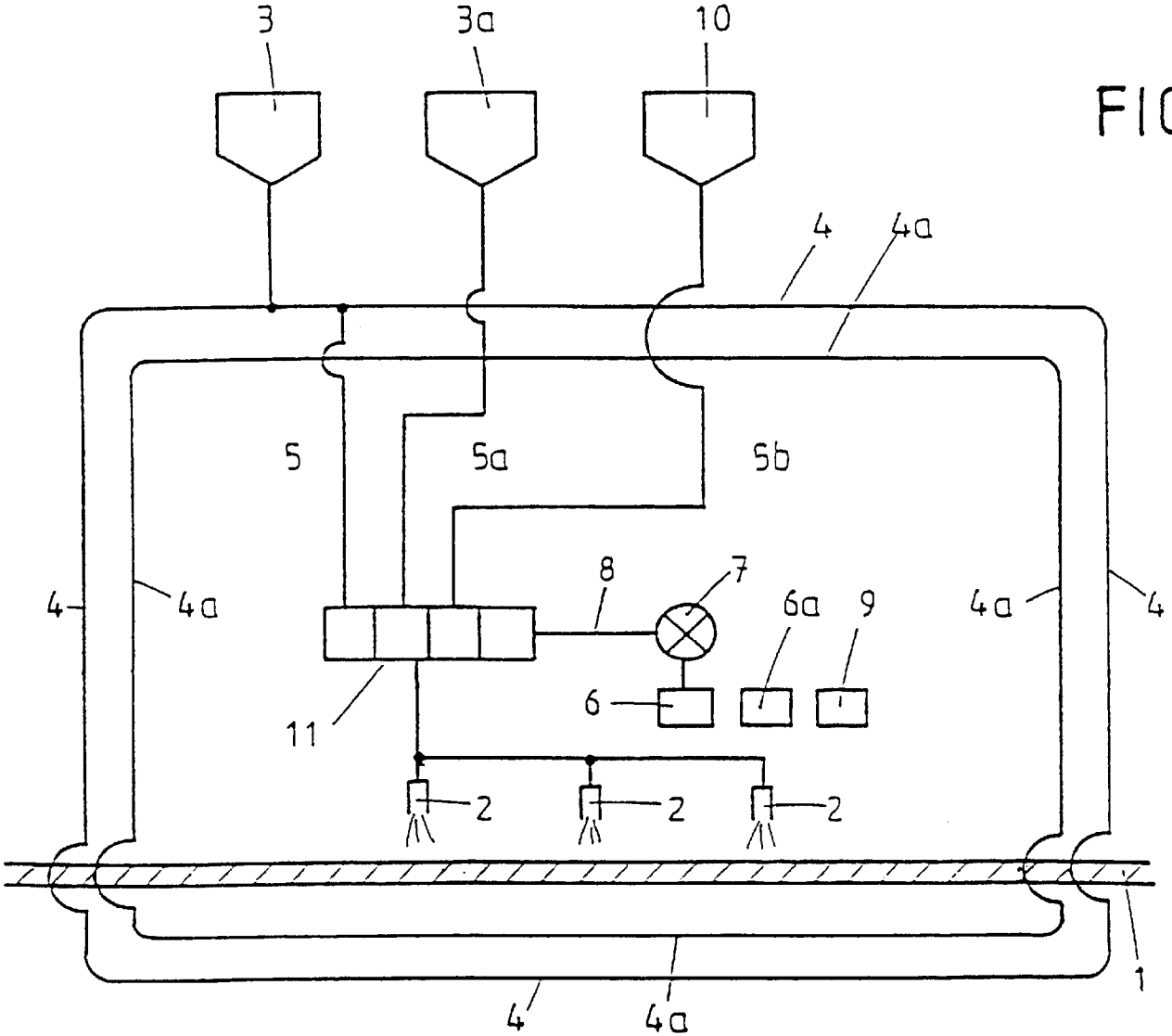
FIG. 2*c* shows, schematically, a system of FIG. 2*b* having a colour changer.

The accompanying FIG. 2*c* illustrates the same system as described in FIG. 2*b*; the reference characters each have the same significance as in FIG. 2*b*. Unlike FIG. 2*b*, the embodiment of the invention illustrated in FIG. 2*c* comprises a colour changer (11). Such a colour changer automatically regulates the supply of lacquers from the individual lacquer storage containers (3) and (3*a*) and the rinsing device (10) to the spraying elements (2). one regulating unit is provided for each lacquer system. The same applies to the rinsing device (10). A regulating unit is also provided for the additional lacquer supply unit used in accordance with the invention which comprises small containers (6, 6*a*), rinsing device (9) as well as lacquer conveying device (7) and stub line (8).

The lacquering line according to the invention may be provided with one or more lacquer supply units based on small containers if frequently alternating different individual lacquering operations are carried out. In such a case, the colour changer (which is indicated in FIG. 2*c* by the reference character (11)) comprises a separate regulating unit for each lacquer supply unit.

Figure 3:
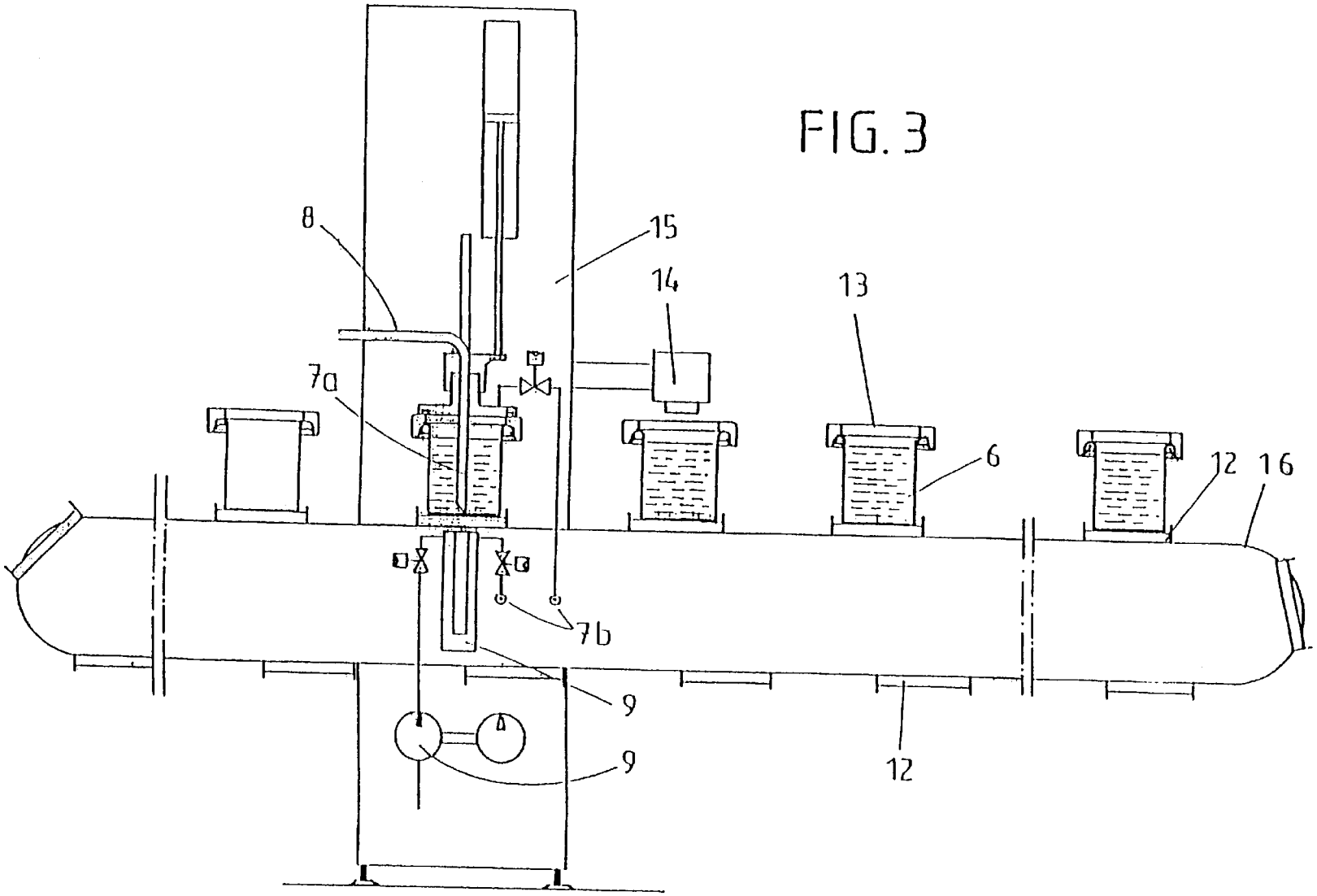
FIG. 3 shows, schematically, a lacquer supply unit for a lacquering line.

FIG. 3 shows an example of an embodiment of the lacquer supply unit provided according to the invention within a lacquering line For the series lacquering of motor vehicle bodies or parts thereof.

Situated on a conveying device (16), formed in the present example by a conveyor belt, are holding devices (12) for small containers (6). The small containers are provided with a lid (13). They are conveyed by the transport device (16) past a bar-code laser (14), which may read a code optionally provided on the lid (13). The small containers (6) are fed to an opening device (15), where a conveying device is introduced in a self-sealing manner. This is effected in the present specific example by a piercing apparatus. The conveying device comprises a rising pipe (7*a*) and, in the case of the present example, a device (7*b*) for supplying a pressure medium, e.g. compressed air. In a similar manner, however, a pumping device might be provided for extracting the contents from the small containers (6). The rising pipe (7*a*) opens into the stub line (8). The latter leads (no longer shown in FIG. 3) optionally via a colour changer to the spraying elements. Integrated into the lacquer supply unit is a rinsing device (9) which, in the present example, is so designed that the rising pipe, after emerging from the small container (6), plunges into a rinsing vessel containing rinsing solution. The rinsing solution may be conveyed by a pumping or pressure medium device into the rising pipe (7*a*) and through the stub line (8) optionally via the colour changer to the spraying elements. Upon completion of lacquering, the small containers (6) are removed by the conveying device (16) and may then be disposed of or collected for subsequent cleaning and refilling.

The lacquers in different colours, e.g. a standard and/or special colour, which are usable in the apparatus according to the invention and for the method according to the invention are packed ready for application into small containers. Packing of the ready-to-apply lacquers into the small containers may be effected at the premises of the lacquer processor, e.g. the automobile manufacturer, but is preferably effected at the premises of the lacquer manufacturer or lacquer supplier. Shortly before application, e.g. prior to breaking open the respective small container, its contents are advantageously thoroughly mixed, e.g. by shaking the small container in a conventional shaking device. Particularly the lacquers in a special colour are preferably not produced from scratch, this being, in the case of a single product or only a low piece number of products to be lacquered in a special colour, disadvantageous from both an economic and practical standpoint, but are preferably produced by the method known, for example, from the field of bodywork repair lacquers using mixed lacquers or semi-finished products, so-called modules. The packed lacquer containers may be used, as described above, directly as small containers provided they are connectable particularly in a sealable manner to a lacquer conveying device. They may however alternatively be inserted into, in particular, compression-proof outer containers serving as small containers, which as such may be sealably connected to the lacquer conveying device.

The invention may be used both in the field of mechanical lacquering and in particular for the lacquering of products manufactured on an industrial scale using lacquers of different colours, e.g. in special and/or standard colours. Said lacquers in different colours are in particular colour- or effect-lending base or coating lacquers. The invention may however be used also with other lacquers in different colours, e.g. clear lacquers of differing transparent tints or filler lacquers.

What is claimed is:

1. A lacquering line for lacquering industrially manufactured products in at least one of standard colours and special colours, comprising:

one or more guide devices (1) for the industrially manufactured products, having one or more lacquering cabins and having spraying elements (2) disposed along the guide devices (1) inside the lacquering cabins, wherein at least one lacquering cabin comprises one or more lacquering units, said lacquering units comprising one or more exchangeable small containers (6, 6*a*) in which a lacquer quantity required for lacquering a predetermined number of individual products is packed ready for application, and a rinsing device (9), wherein the small containers (6, 6*a*) and the rinsing device (9) are each connectable by a lacquer conveying device (7) and one or more stub lines (8) directly or via a colour changer (11) to the spraying elements (2), wherein the small containers (6, 6*a*) are closed and connectable in a sealing manner to the lacquer conveying device (7), wherein the lacquer conveying device (7) comprises a rising pipe (7*a*) insertable into the small containers (6, 6*a*) and a device for pumping or applying a pressure medium, wherein the rising pipe (7*a*) comprises a piercing apparatus.

2. An apparatus according to claim 1, wherein the lacquering units comprising small containers (6, 6*a*) are provided in separate lacquering cabins integrated into the lacquering line.

3. An apparatus according to claim 1, wherein the lacquering units comprising small containers (6, 6*a*) are integrated into lacquering cabins provided with one or more ring lines.

4. A lacquering line according to claim 1, wherein at least one first lacquering cabin comprises one or more units for lacquering industrially manufactured products, wherein one said unit comprises one or more of the exchangeable small containers (6, 6*a*), in which the lacquer quantity required for lacquering a predetermined number of individual products is packed ready for application, and a rinsing device (9), and wherein the one or more small containers and the rinsing device are each connectable by the lacquer conveying device (7) and one or more stub lines (8) directly or via a colour changer to the spraying elements, and optionally, for lacquering in standard colours the lacquering line further comprises one or more second lacquering cabins comprising spraying elements, which are disposed along the guide devices inside said lacquering cabins and are connected by feed lines (5, 5*a*) via one or more ring lines (4, 4*a*) to one or more lacquer storage containers (3, 3*a*) and connected by feed line 5*b* to a rinsing device (10).

5. A lacquering line according to claim 1, comprising one or more third spraying cabins, in which are disposed spraying elements (2) connected by feed lines (5, 5*a*) via one or more ring lines (4, 4*a*) to one or more lacquer storage containers (3, 3*a*) and a rinsing device (10), and the third spraying cabins comprise in an integrated manner one or more lacquering units, wherein one of said lacquering units comprises one or more of the exchangeable small containers (6, 6*a*), the total filling volume of which corresponds to the lacquer quantity required for lacquering a predetermined number of individual products, as well as an additional rinsing device (9), wherein the small containers (6, 6*a*) and the additional rinsing device (9) are connectable in each case by the lacquer conveying device (7) and one or more stub lines (8) directly or via a colour changer (11) to the spraying elements.

6. A lacquering line according to claim 5, comprising as spraying cabins, exclusively one or more of the third spraying cabins.

7. A lacquering line according to claim 4 comprising one or more of the first lacquering cabins for lacquering in special colours and one or more of the second lacquering cabins for lacquering in standard colours.

8. A lacquering line according to claim 1, for lacquering in special colours and standard colours, comprising one or more of the first lacquering cabins.

9. A method for using a lacquering line according to claim 1, comprising:

lacquering motor vehicle bodies or parts thereof.

10. A lacquering line according to claim 1, wherein the lacquering line comprises only one first lacquering cabin.

11. A lacquering line according to claim 1, wherein the one or more small containers (6, 6*a*) are located in the vicinity of the spraying elements (2).

12. A lacquering line according to claim 4 wherein at least one of the feed lines (5, 5*a*) of the ring lines (4, 4*a*), the feed line (5*b*) of the rinsing device (10), and the stub lines (8) are connected by a colour changer to the spraying elements (2).

13. A lacquering line according to claim 12, wherein the small containers (6, 6*a*) are located in the vicinity of the colour changer.

14. A lacquering line according to claim 1, wherein the exchangeable containers (6, 6*a*) each have a filling volume of 0 0.5 to 10 litres.

15. A lacquering line according to claim 1, wherein the small containers (6, 6*a*), the lacquer conveying device (7) and the rinsing device (9) are located in the vicinity of the spraying elements (2).

16. A lacquering line according to claim 1, wherein the small containers (6, 6*a*) and the lacquer conveying device (7) connectable thereto are screened off for preventing contamination.

17. A lacquering line according to claim 1, comprising an automatic conveying device for supplying the small containers (6, 6*a*) to the lacquer conveying device (7).

18. A lacquering line according to claim 1, comprising an automatic device for connecting the small containers (6, 6*a*) to the lacquer conveying device (7).

19. A method for lacquering industrially manufactured products, comprising:

lacquering in a lacquering line according to claim 1.

20. A method according to claim 19, comprising, for individual lacquering, using small containers holding lacquer, the total filling volume of which corresponds to a lacquer quantity required for individual lacquering.

21. A method according to claim 19, comprising:

upon completion of lacquering or individual lacquering, cleaning the lacquer conveying device, the feed lines from the small containers to the spraying elements and the spraying elements, with a rinsing solution.

* * * * *